US007049538B2

(12) United States Patent
Camillo

(10) Patent No.: US 7,049,538 B2
(45) Date of Patent: May 23, 2006

(54) MECHANISM FOR COMPRESSION ACTUATING, BY MEANS OF A ROCKING KEY, SWITCHES, CHANGE-OVER SWITCHES, SELECTORS SWITCHES AND THE LIKE

(75) Inventor: Gusi Piero Camillo, Marostica (IT)

(73) Assignee: Vimar S.P.A. (IT)

( * ) Notice: Subject to any disclaimer, the term of this patent is extended or adjusted under 35 U.S.C. 154(b) by 0 days.

(21) Appl. No.: 10/490,055

(22) PCT Filed: Sep. 26, 2002

(86) PCT No.: PCT/EP02/10822

§ 371 (c)(1),
(2), (4) Date: Aug. 17, 2004

(87) PCT Pub. No.: WO03/030196

PCT Pub. Date: Apr. 10, 2003

(65) Prior Publication Data

US 2004/0262143 A1 Dec. 30, 2004

(30) Foreign Application Priority Data

Sep. 27, 2001 (IT) ..... MI2001A2002

(51) Int. Cl.
*H01H 3/00* (2006.01)

(52) U.S. Cl. ..... 200/339; 200/4

(58) Field of Classification Search ..... 200/339, 200/553, 1 B, 5 R, 4, 6 R, 17 R, 18
See application file for complete search history.

(56) References Cited

U.S. PATENT DOCUMENTS

| | | | | |
|---|---|---|---|---|
| 3,746,809 | A | 7/1973 | Gaber | |
| 5,213,204 | A | 5/1993 | Sommer | |
| 5,293,507 | A * | 3/1994 | Hayakawa | 200/244 |
| 5,329,163 | A * | 7/1994 | Satoh et al. | 307/10.1 |
| 5,436,421 | A * | 7/1995 | Sadowski | 200/558 |
| 5,623,134 | A * | 4/1997 | Hayakawa | 200/5 R |
| 5,982,269 | A * | 11/1999 | Sorenson | 337/380 |
| 6,175,090 | B1 * | 1/2001 | Blossfeld | 200/558 |
| 6,180,905 | B1 * | 1/2001 | Pollock et al. | 200/527 |
| 6,459,060 | B1 * | 10/2002 | Bartok | 200/553 |
| 6,590,175 | B1 * | 7/2003 | Lam | 200/315 |
| 6,774,329 | B1 * | 8/2004 | Shimizu et al. | 200/339 |
| 6,800,825 | B1 * | 10/2004 | Sasaki et al. | 200/402 |

FOREIGN PATENT DOCUMENTS

EP 0 720 191 A 7/1996

* cited by examiner

*Primary Examiner*—Karl D. Easthom
*Assistant Examiner*—Lisa Klaus
(74) *Attorney, Agent, or Firm*—Banner & Witcoff, Ltd.

(57) ABSTRACT

A mechanism is described for compression actuation, by means of a rocking key, of electric controls such as switches, change-over switches, selector switches and the like, in which there are provided at least one fixed contact (12) and one movable contact (11), carried by a movable anchor (10), rotatively actuated to bring the movable contact (11) towards or away from the fixed contact (12), through a pin (21) operated by the rocking key (5) and pushed against said movable anchor by a compression spring (22), where the pin acts against the movable anchor (10) by means of an articulated head or joint (38) shaped like a fork, so that the two branches of the fork arrange themselves on corresponding areas (45) of the anchor that are substantially symmetrical with respect to its center (46).

20 Claims, 6 Drawing Sheets

MECHANISM FOR COMPRESSION ACTUATING, BY MEANS OF A ROCKING KEY, SWITCHES, CHANGE-OVER SWITCHES, SELECTORS SWITCHES AND THE LIKE

This application is a National Stage application of co-pending PCT application PCT/EP02/10822 filed Sep. 26, 2002, which was published in English under PCT Article 2(2) on Apr. 10, 2003, and which claims the benefit thereof, which also claims priority of Italian Patent Application No. MI2001A 002002, filed Sep. 27, 2001. These applications are incorporated herein by reference in their entirety.

DESCRIPTION

Brief Summary of the Invention

This invention relates to a compression device to actuate, by means of a rocking push button, switches, change-over switches, selector switches and electrical equipments in general.

Switches are mainly mentioned hereinafter, it being however understood that what is said is applicable to any other type of electrical equipment used to open or close at least one load supplying electrical circuit.

It is known that the devices that actuate switches by means of rocking pushbuttons require, between the push button and the anchor carrying the movable contacts, an element that follows the rocking movement of the pushbutton and works by overcoming the dead centre.

In one case, between said element and the rocking pushbutton there is provided a traction spring which causes the said element to switch from an extreme position to the other when the rocking of the pushbutton exceeds a certain angle. The movement of the element under traction produces an oscillation of the anchor carrying the movable contact that causes the opening or closing of the circuit, as a result of the movable contact moving away form or, respectively, toward the corresponding fixed contact of the switch.

In the case of compression actuating mechanisms, the element between the pushbutton and the anchor carrying the movable contact is normally a pin which is pushed by a compression spring against the anchor, so that the pin shift following the rocking of the pushbutton causes the oscillation of the anchor carrying the movable contact upon overcoming the dead centre.

These compression actuation mechanisms, though widely spread, have a number of drawbacks.

For example, they require a rather wide oscillation angle of the rocking push button, as a rule of not less than 12°, as well as a certain force for actuating the pushbutton, giving a feeling of heaviness of the whole assembly.

Such known compression devices also cause remarkable rebounds of the movable contact on the fixed contact upon closing, with a resulting extension of the electric arc and hence a relatively quick wear of the silver layer that usually coats the contacts.

Another drawback of said known mechanisms is that they often make it difficult to break the possible welding bond that occurs due to the passage of overcurrents.

The purpose of the compression actuating mechanism, by means of a rocking pushbutton, of switches, change-over switches, selector switches and the like according to the invention is to eliminate the above-mentioned drawbacks of the similar devices known in the art.

In particular, an aim of the invention is to provide such a mechanism that may be actuated by means of a reduced rocking pushbutton angle, thus making also the actuation of the pushbutton lighter.

Another aim of the invention is to reduce the rebounds of the movable contact on the fixed contact, hence the duration of the electric arc during closure.

Yet another aim of the invention is to allow easy breaking of the possible welding bond between the contacts that might occur due to the passage of overcurrents.

These aims are achieved by the compression actuating mechanism according to the invention, which has the characteristics listed in the attached independent claim 1.

Advantageous embodiments of the invention appear from the dependent claims.

Substantially, according to the invention, at the end of the pin that acts by compression on the anchor carrying the movable contact there is provided an articulated head or joint, which substantially acts on fixed points of the anchor.

Conveniently, said joint is substantially shaped like a fork which, as a result of a small rotation produced by the actuation of the pushbutton, causes the oscillation of the anchor carrying the movable contact, and thus the opening or closing of the circuit.

Conveniently, the pin with jointed head according to the invention, around which a helicoidal compression spring is arranged, is housed in a guided manner in a suitable sleeve projecting below the pushbutton and can be blocked in it by means of a snap-in end pawl provided on the pin, which facilitates automatic assembly.

The bolt-joint assembly of the mechanism according to the invention can be applied to all traditional controls: switches, change-over switches, selector switches, bipolar switches etc., without modifying their structure.

Further features of the invention will appear clearer from the following detailed description, which is referred to a merely exemplifying, therefore not limiting embodiment, illustrated in the attached drawings, where:

DETAILED DESCRIPTION OF THE INVENTION

Figure 3:
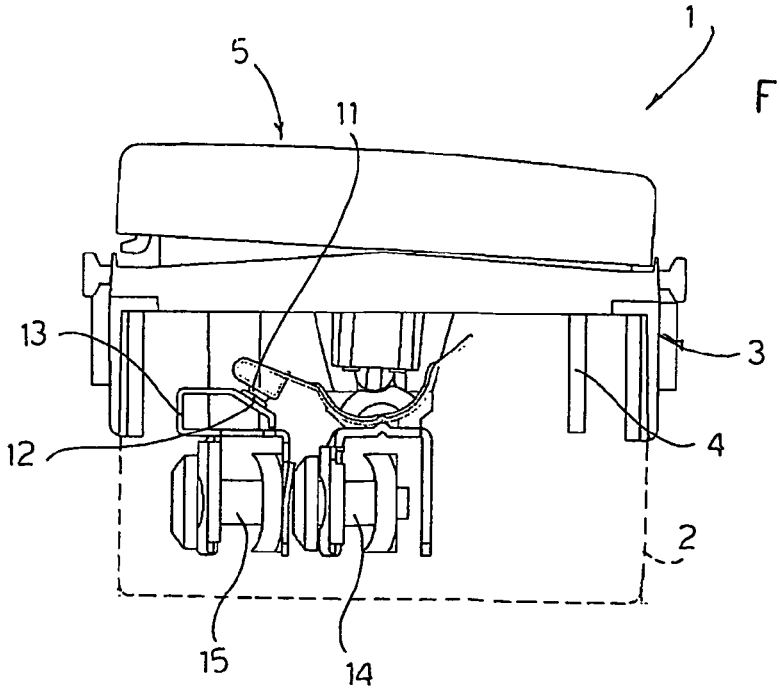
FIG. 3 is a side elevation view of the mechanism of FIG. 2, showing schematically also the housing of the electric switch containment module.
Figure 4:
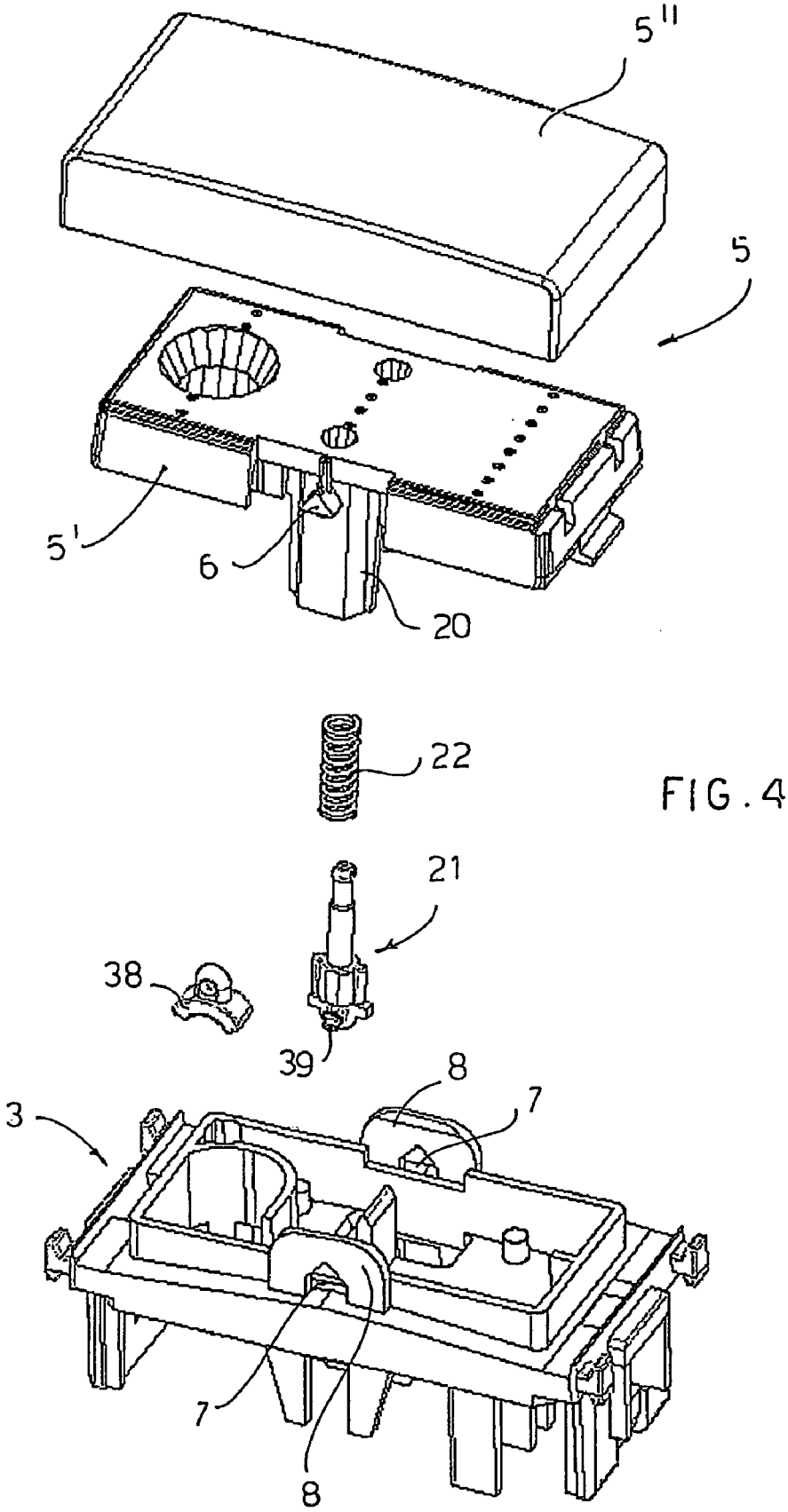
FIG. 4 is an explosed isometric view of the mechanism according to the invention, without contacts and terminals.

With reference to the annexed figures, and for the moment in particular to FIG. 3, reference numeral 1 indicates, as a whole, an electric mudule for installation in built-in boxes including in this case an ordinary switch. Of course, however, what is said hereinafter is applicable to any type of control, such as switches, change-over switches, selector switches, pushbuttons, bipolar switches and the like, where the number and/or position of the electric contacts changes case by case.

FIG. 3 shows in dashed lines the body 2 of module 1, which from now on will be called switch, with the provision that what has been specified above remains unchanged.

The body 2 consists substantially of a box-shaped housing made from plastic material, which contains the contacts and electric terminals of the switch, to which reference will be made later.

The body 2 accommodates a fitted-in lid which has a set of downward protrusions 4, which will limit and/or block the internal parts of the switch in a manner known per sé, which will not be further described.

On the lid 3 there is hinged, at its central part, a rocking push button 5, which controls the switch actuating mechanism.

In particular, in the illustrated example, the rocking pushbutton 5 is hinged to the lid 3 by means of a pair of triangular side projections 6 provided on the pushbutton, which are engaged, with a certain clearance, in corresponding seats 7 provided in a pair of opposite fins 8 rising from the two sides of lid 3.

The pushbutton 5 consists in reality of a suitably shaped body 5', which among other things contains said projections 6, covered by a protective and embellishing lid 5". However, for the sake of simplicity, hereinafter the pushbutton 5 will be meant to indicate the assembly of both elements 5' and 5" without distinction between the two.

The operation of the rocking pushbutton 5 causes, by means of a compression actuating device that will be better described later, the oscillation of an anchor 10, substantially shaped as a saddle turned upside down, which carries at one end a movable contact 11 to move it close to or away from a corresponding fixed contact 12, which is installed on a contact holder 13, to close or open, respectively, an electric circuit whose ends are connected to the terminals 14, 15, which are electrically connected to the movable contact 11 and the fixed contact 12, respectively.

Before illustrating the compression actuating device according to the invention, a mechanism of the prior art will be described, with reference to FIG. 1, which is turned by 180° with respect to FIG. 3.

In said figure the same references are used as previously introduced to indicate the corresponding elements of the device.

Figure 1:
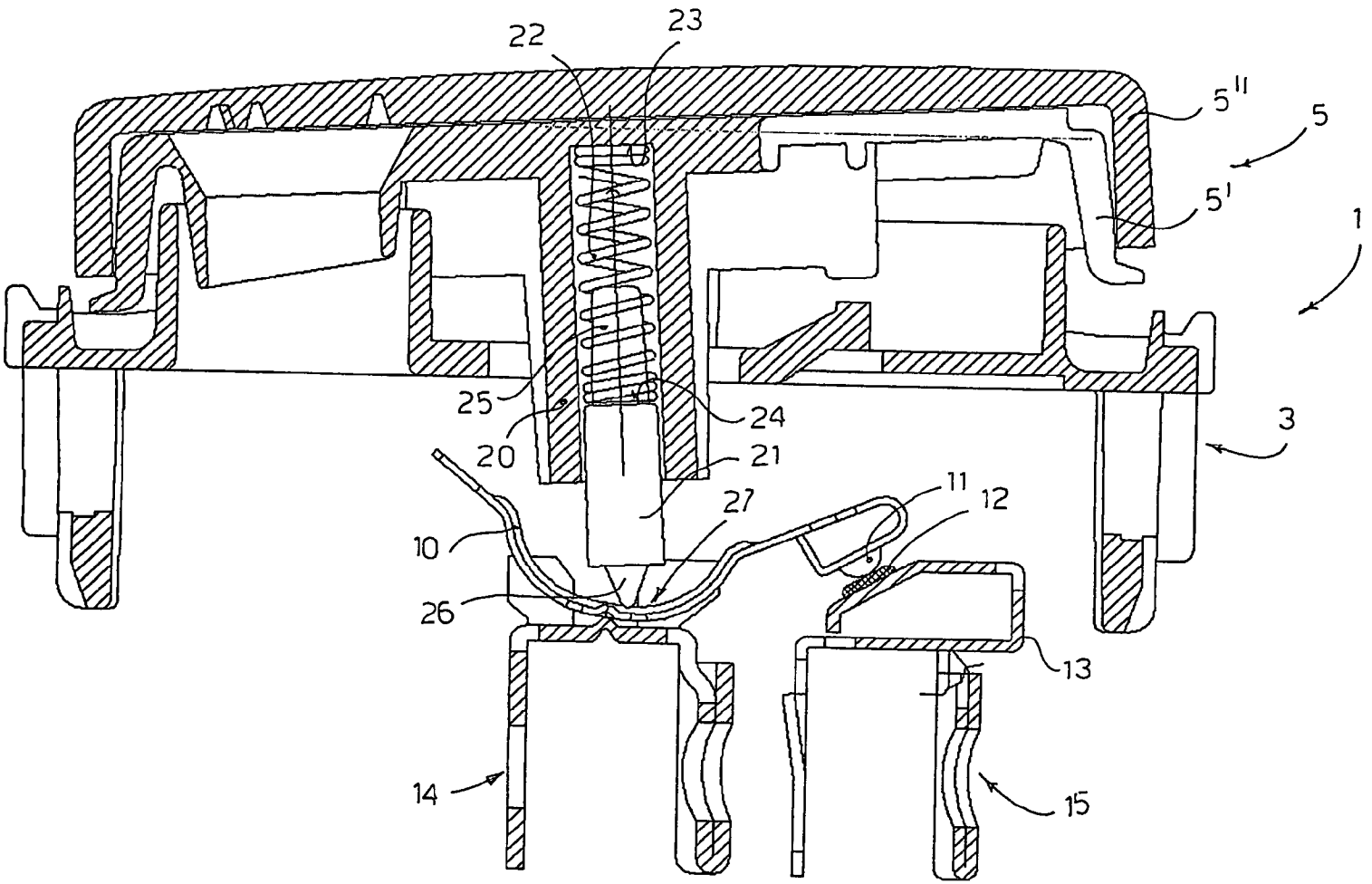
FIG. 1 is a middle cross-sectional view showing a compression actuating mechanism, by means of a rocking push button, of a switch according to the prior art.
Figure 2:
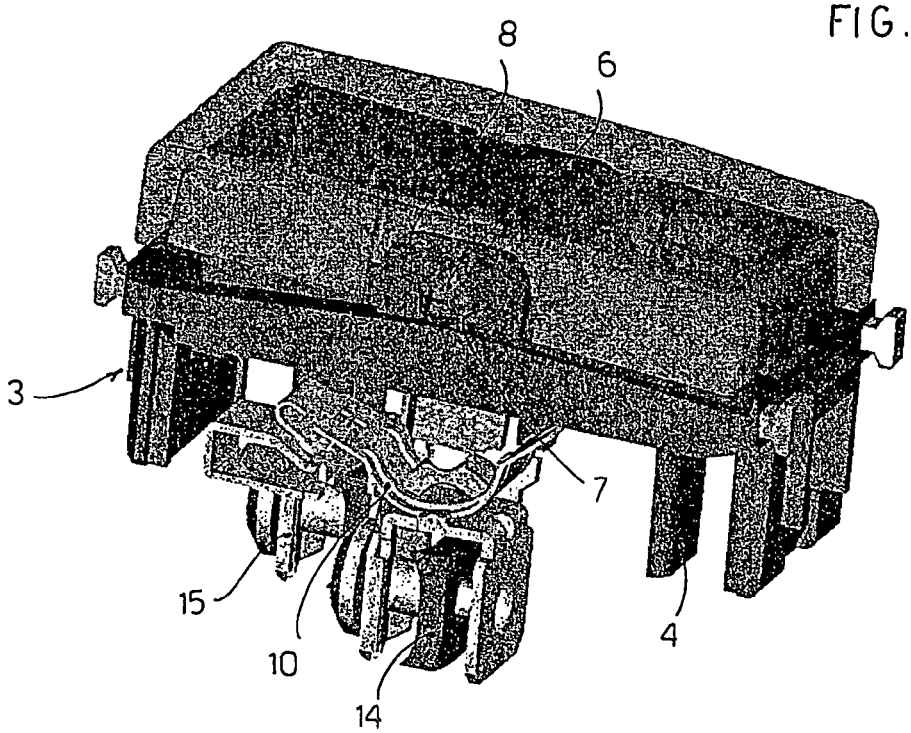
FIG. 2 is a schematic isometric view of a compression actuating mechanism, by means of a rocking pushbutton, of a switch according to the invention.

As can be seen in FIG. 1, a substantially cylindrical sleeve 20 projects below the pushbutton 5, which partially houses a pin 21 contrasting a helicoidal spring 22, which works by compression, acting between the bottom 23 of the sleeve 20 and an annular shoulder 24 provided on the pin 21, an upper portion 25 of which is inserted in the spring 22.

The pin 21 ends with a free pointed tip 26, which is constantly pressed against the concave part of the anchor 10 carrying the mobile contact 11, keeping it in either of the two possible positions, that of closed circuit as shown in FIG. 1 and that of open circuit which is obtained with the rocking pushbutton arranged in the opposite position.

The passage from one position to the other occurs by overcoming the dead centre, which causes the mobile anchor 10 to switch from one position to the other, when, during the rocking of the pushbutton, the pin 21, which rotates integrally with it, goes beyond the central vertical position.

In practice, during the rocking of pushbutton 5, the tip 26 of pin 21 slides inside the concave surface 27 of the movable anchor 10, making it swing to open or close the circuit when it goes beyond the centre of the anchor, which theoretically corresponds to the dead centre of the mechanism.

For proper operation, the mechanism described above requires a rather wide oscillation angle of the controlling rocking pushbutton 5, for example not less than 12°, as well as a certain operation force, which gives the user a feeling of heaviness in the rocking of the pushbutton.

In addition, with a similar device the only mass involved in the circuit opening and closing steps is that of the movable anchor 10, which switches from one position to the other when it overcomes the dead point. In the closing step this causes considerable rebounds of the movable contact 11 on the fixed contact 12, with the previously described effects due to the length of the electric arc.

With reference now to figures from 2 to 9, the solution proposed by the invention is described with reference to the same switch structure, trying to use the same already introduced reference numerals.

An essential feature of the invention is that pin 21, which works by compression, does not act directly on the movable anchor 10, but through an end joint which will be better described later.

Figure 7:
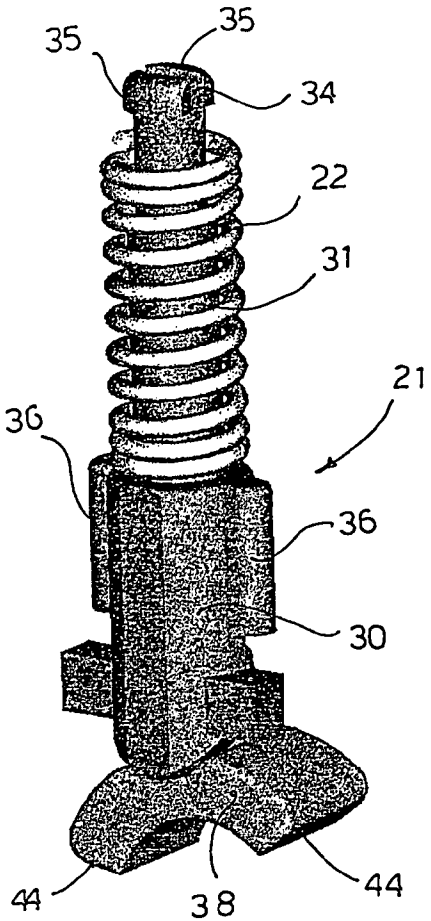
FIGS. 6 and 7 are isometric views, from opposite angles, illustrating the pin with joint of the mechanism according to the invention.
Figure 6:
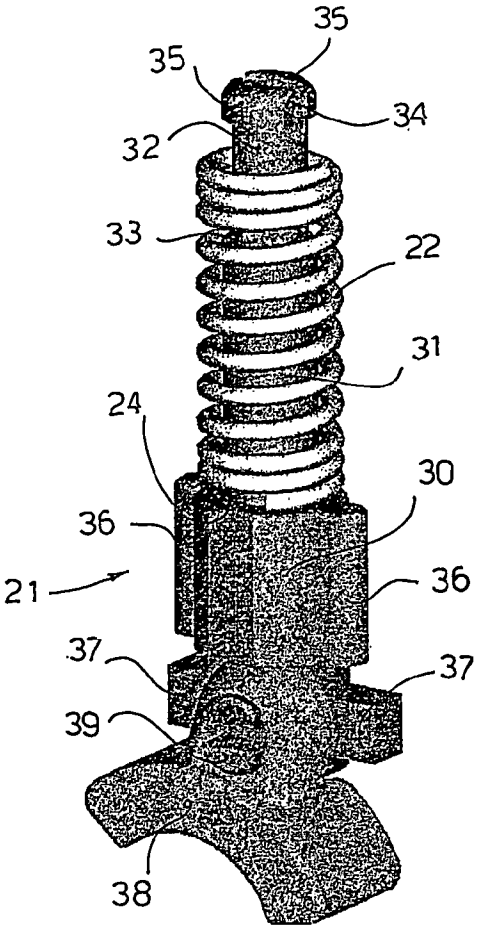
Figure 5:
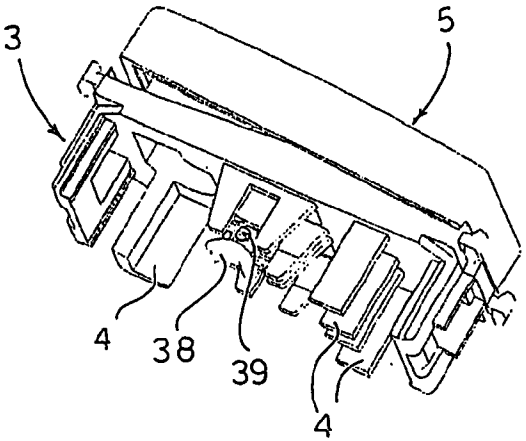
FIG. 5 is an isometric view from below of the mechanism of FIG. 4 in assembled condition.

With reference, in particular, to FIGS. 6 and 7, note that the pin 21 has a lower part (with reference to the orientation of the figures) or base 30, and an upper part or stem 31 of smaller diameter, between which a shoulder 24 forms, against which abuts an end of the helicoidal spring 22 provided around the stem 31. The stem 31 ends upwardly with a portion 32 of smaller diameter, such as to determine on the contour of the stem 31 a circular abutment 33.

The upper free end of stem 31, or better its terminal part 32, is provided with a radial notch 34 which sets the limits of two opposite teeth 35, which project beyond the diameter of said terminal portion 32.

The base 30 of the pin 21 is provided with two opposite fins 36 which extend longitudinally parallel to the axis of pin 21, under which two further opposite radial projections 37 are provided.

The pin 21 ends downwardly with an articulated head or joint 38, shaped like a fork or a C turned upside down, which is hinged on pin 21 by means of an orthogonal expansion pin 39 which in the example is shown as a solid body with pin 21 so that it can rotate in a plane that contains the axis of pin 21, and passing through the opposite fins 36.

During installation, the maximum rotation angle of the joint 38 is limited by said opposite radial projections 37, against which the upper surface of the joint abuts on.

Now, with reference in particular to FIGS. 8 and 9, the installation of the pin 21 with the joint 38 in the rocking pushbutton is illustrated first, later followed by the operation thereof.

As can be seen from the figures, the sleeve 20, which protrudes below the pushbutton 5 is provided, at its mouthpiece, with two opposite longitudinal cavities 40, suitable to accommodate the two opposite fins 36 which act as guides to prevent the pin from rotating around its axis and ensure proper operation thereof.

Close to the bottom, the sleeve 20 is provided with a transverse partition 42 with a central hole 43 for snap insertion of the end of pin 21. In practice, the two opposite teeth 35 yield elastically during insertion into the hole 43 thanks to the presence of the notch 34 and later expand, thus constraining the pin 21 to the pushbutton 5 and, if necessary, compressing the spring 22, whose upper end abuts on the said partition 42. The spring 22 will be further compressed during operation when pushbutton 5 is installed on lid 3 of body 2 of the switch, with the joint 38 abutting and pressing on the concave surface of the movable anchor 10.

Of course the pin 21 structure described above is not limitative for the purposes of the invention, even though it is preferred because it allows completely automatic installation of the pin. Thus, for example, the opposed teeth 35 which allow a snap installation of the pin are useful because they constrain the pin to the pushbutton, but the possibility of installing the pin 21 completely free in the sleeve 20 is also contemplated.

The ends 44 of the fork joint 38 are suitably beveled off in order that their extensions converge onto the axis of the pin 21. The angle of the bevelled ends 44 essentially corresponds to the bending angle of anchor 10, so that fork joint 38 may rest against the concave surface of anchor 10 on two areas 45 arranged substantially symmetrically with respect to the centre 46 of the anchor, resting on a peak 47 of a support 48, which is electrically connected to the corresponding terminal 14.

With the structure of the compression actuating mechanism according to the invention, the operation of rocking pushbutton 5 in either direction causes a rotation in the opposite direction of the fork joint 38, which in turn causes a similar rotation of the anchor 10 carrying the movable contact 11, thus moving it toward, or away from, the fixed contact 12.

Figure 8:
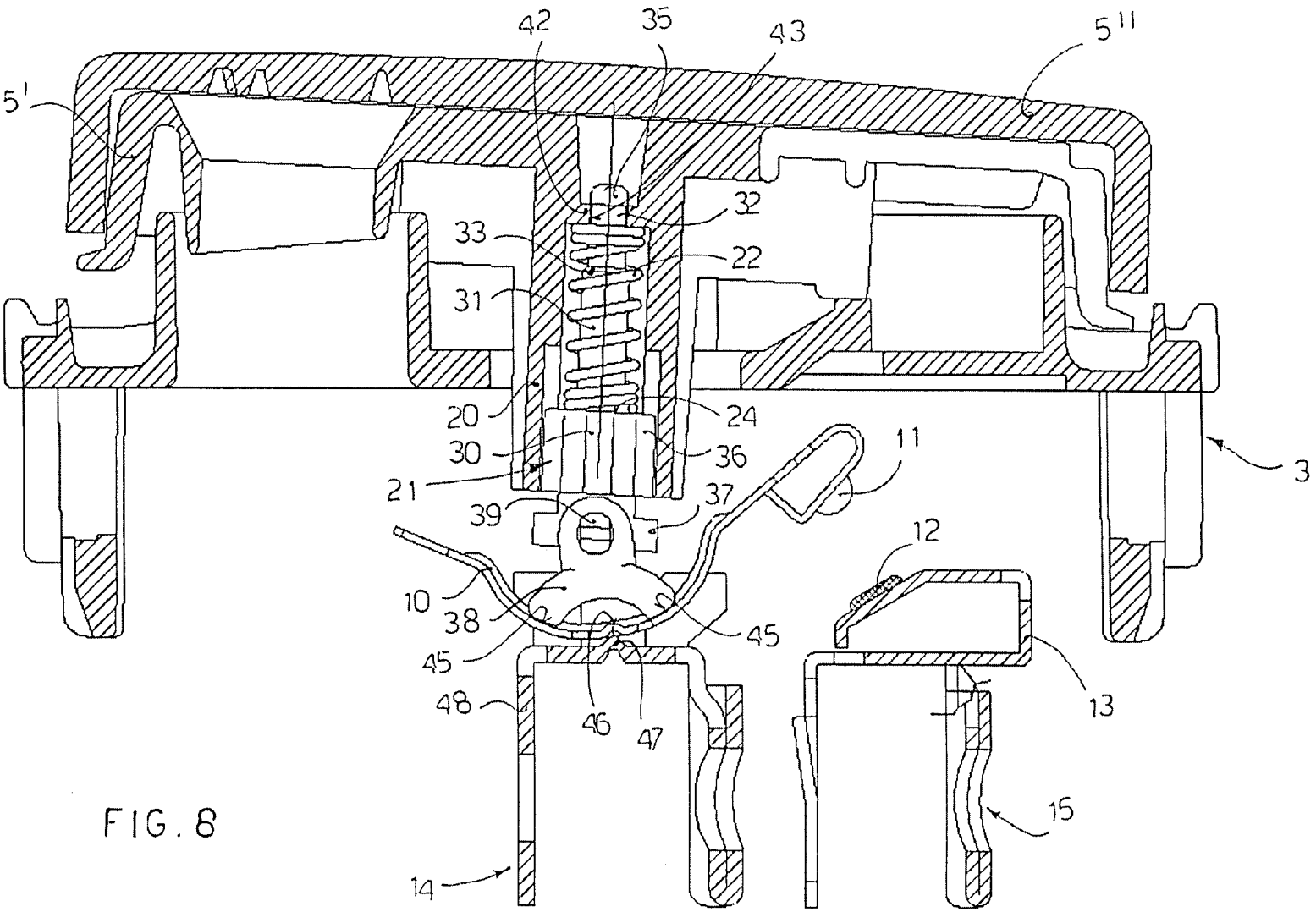
FIGS. 8 and 9 are middle cross-sectional views like that in FIG. 1, illustrating the compression actuating mechanism according to the invention, in the opened and closed conditions, respectively.
Figure 9:
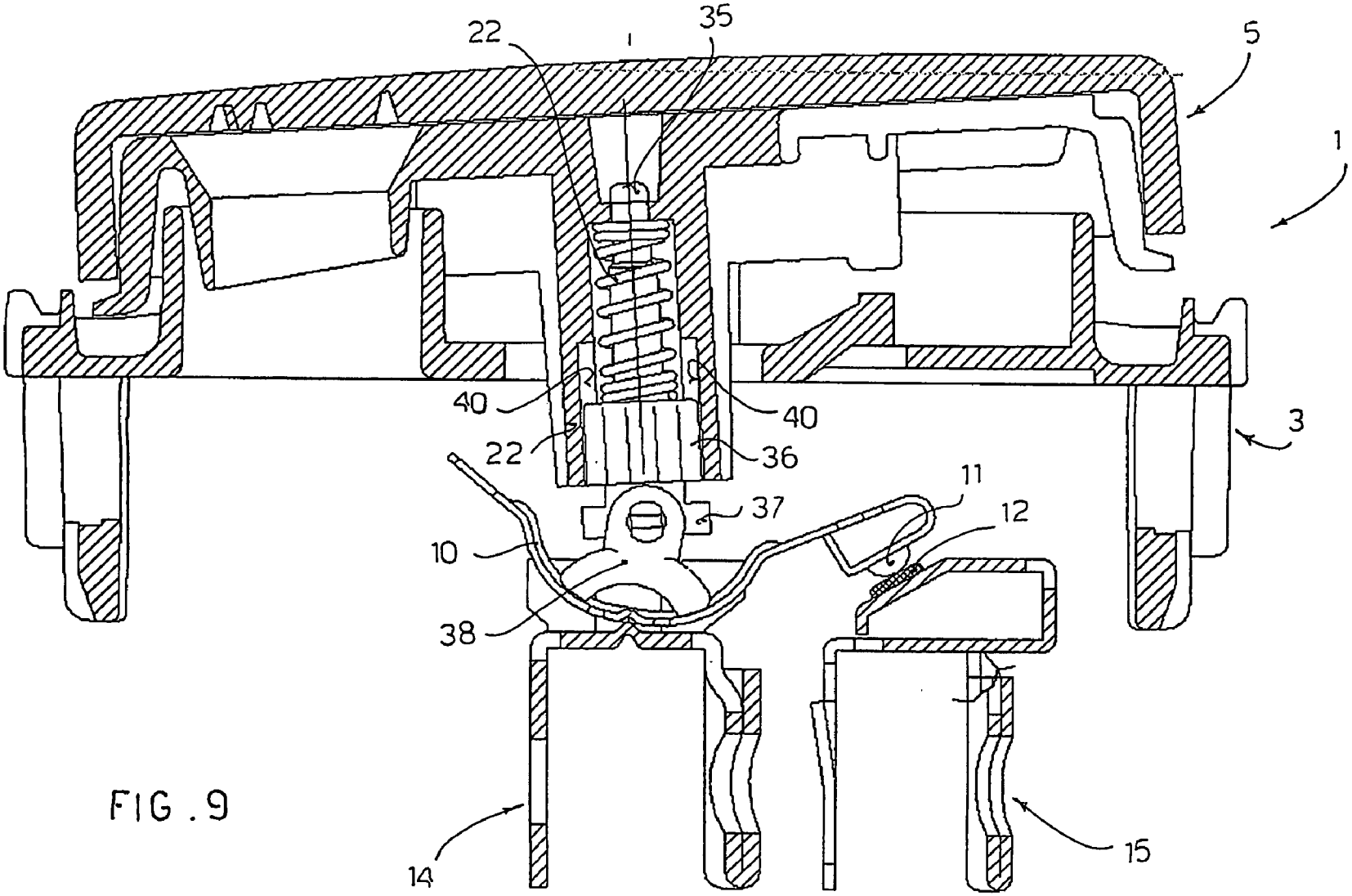

Starting for example from the open circuit condition illustrated in FIG. 8, turning the rocking pushbutton 5 counterclockwise will cause clockwise rotation of the fork joint 38, which, by pressing on anchor 10, makes it rotate in the same direction (clockwise), thus closing the contacts, as shown in FIG. 9.

On the contrary, starting from the closed circuit condition of FIG. 9, turning the toggle pushbutton 5 clockwise will produce counterclockwise rotation of the fork joint 38, which will cause the anchor 10 to turn in the same direction, thus opening the contacts (FIG. 8).

The kinematics is such that a small rotation angle of the rocking pushbutton 5 is sufficient to control the compression actuating mechanism according to the invention.

It appears from the measurements made that the rocking of pushbutton 5 to control the mechanism according to the invention is virtually half that required to control a mechanism of the prior art working in the same switch structure, as shown in FIG. 1.

So, if the switch pushbutton of FIG. 1 requires a 12° rocking, according to the invention a 6° rocking is sufficient to obtain the same circuit opening and closing features, in particular the same distance of the movable contact 11 from the fixed contact 12 during the circuit opening step.

Of course, this is due to the fact that the pin 21 does not act directly on the anchor 10, on which it would be compelled to slide (FIG. 1), but through the fork joint 38, which works on two areas 45 symmetrically arranged with respect to the centre of the anchor, thus producing a multiplying effect of the rotation of the pushbutton on the anchor itself.

The reduction of the rocking angle of pushbutton 5 and the way its rotation is transferred to the anchor 10 carrying the movable contact 11 produces a lightening of the rocking feeling, even though the compression spring 22 and the electrical features are the same as those of the switch structure of the prior art shown in FIG. 1.

As mentioned above, during the circuit closing step a remarkable reduction of the rebounds of the movable contact 11 on the fixed contact 12 is obtained, resulting in a shorter duration of the electric arc and less wear of contacts 11 and 12. This is due to the fact that anchor 10 is practically guided in its movement by the fork joint 38, which acts on the two areas 45 thereof, and there is an increase in the moving masses, which in the solution of the known art of FIG. 1 were limited to the anchor mass, or better of the long arm of the anchor that carries the movable contact 11.

Note that in the contact opening and closing steps the anchor 10 makes a translational movement on support 48, resulting in a sliding of movable contact 11 on fixed contact 12, which allows the breaking of any welding bonds that might occur due to the passage of overcurrent.

The above description highlights the advantages of the compression actuating mechanism, by a rocking pushbutton, of electrical controls such as switches, change-over switches, selector switches, pushbuttons, bipolar switches and the like.

However, the invention is not limited to the specific embodiment described above and illustrated in the attached drawings, but it can be the object of a number of detail modifications within the ability of any skilled in the art without exceeding the extent of the invention as specified in the following claims.

What is claimed is:

1. A compression actuating mechanism, by means of a rocking pushbutton, of electrical controls, comprising at least one fixed contact, with a contact holder connected to a corresponding terminal, and at least a corresponding movable contact, carried by an anchor installed movably on a support, which is electrically connected to a corresponding terminal, the mechanism comprising a pin placed between said rocking pushbutton and the movable anchor, and pushed against the said movable anchor by a compression spring working in compression so that rotation of the rocking pushbutton in either direction causes a corresponding rotation of the movable anchor and therefore the opening or closing of the electric circuit connected to said terminals, to bring said movable contact away from or toward said fixed contact, the pin acting on said movable anchor through an articulated head or joint, characterized in that said joint is shaped like a fork whose two branches are in contact with the movable anchor at points which are substantially symmetrical with respect to the centre of the anchor.

2. A mechanism according to claim 1, characterized in that the ends of the two branches of the fork joint are beveled off by a same angle of curvature of the movable anchor, so that between the joint and the anchor two contact areas form which are substantially symmetrical with respect to the centre of the anchor.

3. A mechanism according to claim 2, characterized in that said pin is housed in a guided manner in a sleeve projecting from inside said pushbutton.

4. A mechanism according to claim 3, characterized in that said pin is provided at an upper end with elastic teeth for snap engagement of a transverse partition of the sleeve, provided with a hole in order to constrain the pin to the pushbutton.

5. A mechanism according to claim 4, characterized in that a rocking angle of said pushbutton is limited, to approximately 6°, and to the rocking angle corresponds an amplified rotation of said movable anchor.

6. A mechanism according to claim 1, characterized in that said pin is housed in a guided manner in a sleeve projecting from inside said pushbutton.

7. A mechanism according to claim 6, characterized in that said pin is provided at an upper end with elastic teeth for snap engagement of a transverse partition of the sleeve, provided with a hole in order to constrain the pin to the pushbutton.

8. A mechanism according to claim 7, characterized in that said compression spring acts between said partition and a shoulder which marks the limits of parts of the pin having different diameters.

9. A mechanism according to claim 8, characterized in that said joint is installed on said pin by means of an expansion pin which is orthogonal to the pin.

10. A mechanism according to claim 8, characterized in that the rocking angle of said pushbutton is limited, to approximately 6°, and to it there corresponds an amplified rotation of said movable anchor.

11. A mechanism according to claim 10, characterized in that the electrical control that the mechanism is contained in a box closed with a lid, on which said rocking pushbutton is installed.

12. A mechanism according to claim 11, characterized in that the mechanism is contained, together with the electrical control to be actuated, in a module for built-in electrical installations.

13. A mechanism according to claim 1, characterized in that in a lower part of the pin two opposite radial projections are provided, so as to limit the maximum angular excursion of the joint during installation.

14. A mechanism according to claim 13, characterized in that during the circuit opening and closing steps said movable anchor makes a translational movement on said support, thus causing said movable contact to slide on said fixed contact.

15. A mechanism according to claim 1, characterized in that said joint is installed on said pin by means of an expansion pin which is orthogonal to the pin.

16. A mechanism according to claim 1, characterized in that a rocking angle of said pushbutton is limited, to approximately 6°, and to the rocking angle there corresponds an amplified rotation of said movable anchor.

17. A mechanism according to claim 1, characterized in that in a lower part of the pin two opposite radial projections are provided, so as to limit the maximum angular excursion of the joint during installation.

18. A mechanism according to claim 1, characterized in that during the circuit opening and closing steps said movable anchor makes a translational movement on said support, thus causing said movable contact to slide on said fixed contact.

19. A mechanism according to claim 1, characterized in that the electrical control that the mechanism operates is contained in a box closed with a lid, on which said rocking pushbutton is installed.

20. A mechanism according to claim 1, characterized in that the mechanism is contained, together with the electrical control to be actuated, in a module for built-in electrical installations.

* * * * *

UNITED STATES PATENT AND TRADEMARK OFFICE

CERTIFICATE OF CORRECTION

PATENT NO. : 7,049,538 B2
APPLICATION NO. : 10/490055
DATED : May 23, 2006
INVENTOR(S) : Gusi Piero Camillo It is certified that error appears in the above-identified patent and that said Letters Patent is hereby corrected as shown below:

On the cover page, Title Item (54):
Please replace "Selectors" with --Selector--

On the cover page, References Cited Item (56), U.S. Patent Documents:
Please insert the following reference: --2,790,867 4/1957 Sparr--

In Column 6, Claim 1, Line 34:
Please replace "the said movable" with --the movable--

In Column 6, Claim 5, Line 61:
Please replace "angle corresponds" with --angle there corresponds--

Signed and Sealed this

Second Day of October, 2007

JON W. DUDAS
*Director of the United States Patent and Trademark Office*